US005653167A

United States Patent [19]

De Volder

[11] Patent Number: 5,653,167

[45] Date of Patent: Aug. 5, 1997

[54] PAD PRINTING MACHINE

[76] Inventor: Laurent De Volder, Aalterstraat 11, B-9880 Maria-Aalter, Belgium

[21] Appl. No.: 431,091

[22] Filed: Apr. 28, 1995

[30] Foreign Application Priority Data

May 2, 1994 [BE] Belgium ..... 09400443

[51] Int. Cl.[6] ..... B41F 1/00

[52] U.S. Cl. ..... 101/163; 101/41

[58] Field of Search ..... 101/163, 41, 44, 101/35, 150, 151, 164, 165, 166, 170

[56] References Cited

U.S. PATENT DOCUMENTS

| | | | |
|---|---|---|---|
| 4,060,031 | 11/1977 | Philipp | 101/163 |
| 4,314,504 | 2/1982 | Combeau | 101/41 |
| 4,508,032 | 4/1985 | Philipp | 101/163 |
| 4,615,266 | 10/1986 | DeRoche et al. | 101/163 |
| 4,738,198 | 4/1988 | Sillner | 101/44 |
| 4,905,594 | 3/1990 | Phillips et al. | 101/163 |

FOREIGN PATENT DOCUMENTS 23 34 179 1/1975 Germany .

*Primary Examiner*—Christopher A. Bennett

*Attorney, Agent, or Firm*—Spencer & Frank

[57] ABSTRACT

A pad printing machine includes: a cliché plate; a pad disposed above the cliché plate; and a transmission mechanism operatively connected to the cliché plate and to the pad. The transmission mechanism includes a main shaft; a main arm connected to the cliché plate and pivotably mounted on the main shaft; a pivot arrangement connected to the main arm; a lever pivotably mounted on the pivot arrangement and being connected to the pad; and an arrangement for controlling a pivoting motion of the main arm and the lever including: a first cam operatively coupled to the main arm; a groove disposed in one of the first cam and the main arm for controlling a pivoting motion of the main arm in response to a rotation of the first cam; and a second cam operatively coupled to the lever such that a rotation of the second cam controls a pivoting motion of the lever. The transmission mechanism further includes a drive for actuating the transmission mechanism to move the cliché plate and the pad.

12 Claims, 2 Drawing Sheets

PAD PRINTING MACHINE

FIELD OF THE INVENTION

The invention relates to a pad printing machine, more particularly a pad printing machine comprising a cliché plate on which a cliché is fixed, a pad, a transmission mechanism and a drive which moves the cliché plate and pad in an appropriate way with respect to one another through the intermediary of the transmission mechanism.

BACKGROUND OF THE INVENTION

A lot of pad printing machines are already known which involve use of a cliché plate and a pad and which achieve a predetermined movement through a transmission mechanism to both the cliché plate and the pad, that the cliché yielding a perfect print on the pad so that subsequently an object can be printed optimally.

A drawback of known pad printing machines, of which U.S. Pat. No. 4,905,594 is a typical example, is that the transmission mechanism which imposes the specific movements to the cliché plate and the pad is composed of a large number of components among which two cam mechanisms, the first one for actuating the pad motions and the other one for displacements of the cliché plate. The two cam mechanisms are mounted on a common shaft. The construction of these known pad printing machines is usually time consuming, difficult and expensive, which has repercussions on the final cost price of the product.

Another adverse effect in connection with known pad printing machines is that, due to the large number of components, the risk of a defect is relatively high since the overall risk of a defect to the pad printing machine is the sum of all individual risks of a defect to each component and is thus directly proportional to the number of components in the machine.

SUMMARY OF THE INVENTION

The present invention has therefore as an object a pad printing machine which obviates the above mentioned and other drawbacks completely.

A pad printing machine according to the invention comprises a cliché plate, a pad, a transmission mechanism and a drive moving the cliché plate and the pad with respect to one another by means of the transmission mechanism, thee pad printing machine including a main arm which is swingably mounted around a shaft and connected to the cliché plate; a lever which is swingably mounted around a pivot connected to the main arm, this lever being connected to the pad; and of means which control respectively the swinging motion of the main arm and the lever.

In this way, a pad printing machine is obtained which comprises much less components than known pad printing machines, whereby the above mentioned and other drawbacks of known pad printing machines are obviated.

BRIEF DESCRIPTION OF THE DRAWINGS

To demonstrate the characteristics of the invention better, a preferred embodiment of a pad printing machine according to the invention is described hereinafter by way of example with reference to the annexed drawings, wherein.

DETAILED DESCRIPTION OF THE INVENTION

Figure 1:
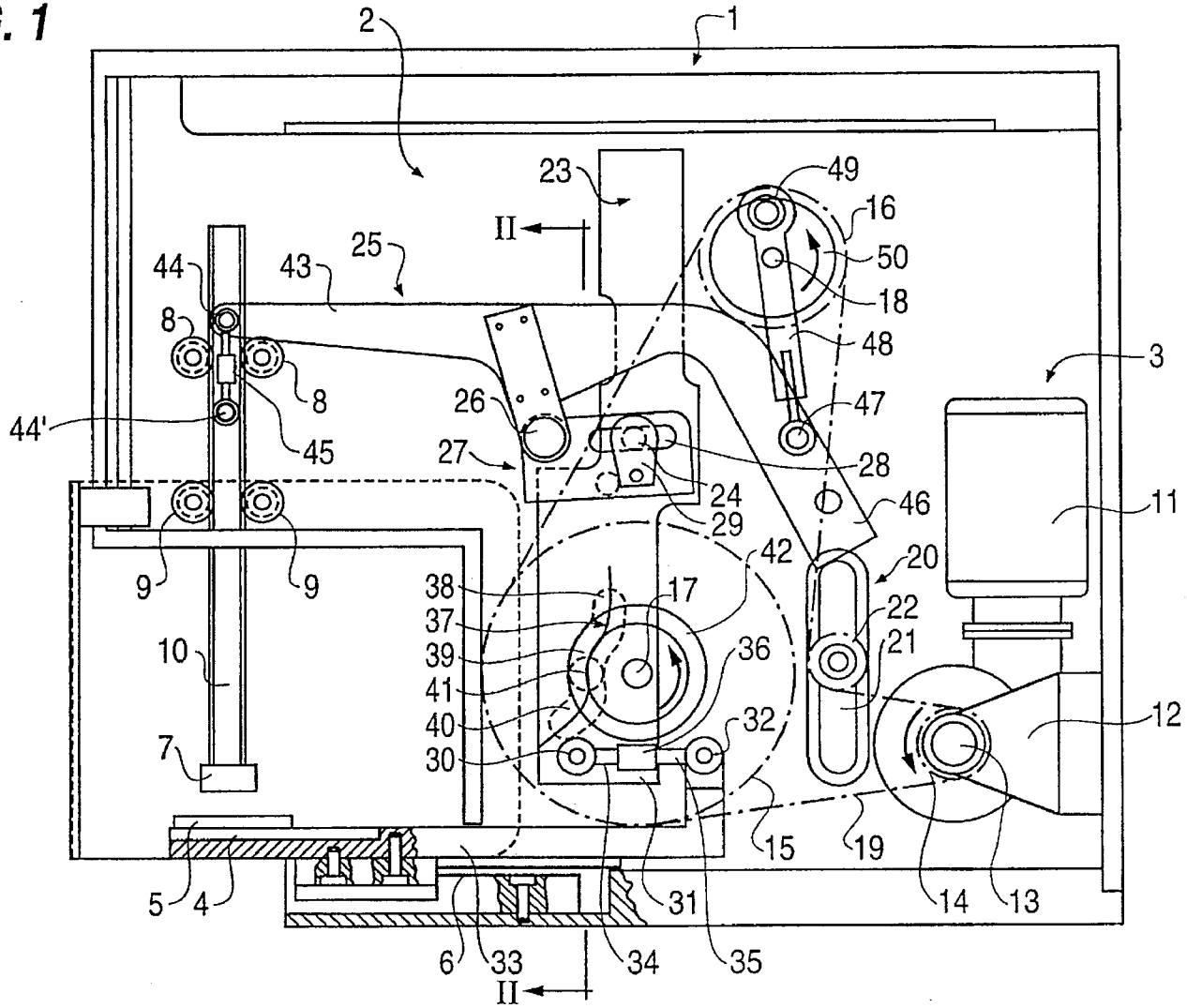
FIG. 1 shows a schematic side view of a pad printing machine according to the invention.
Figure 2:
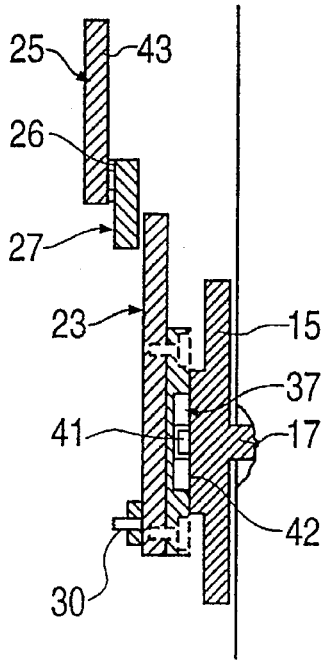
FIG. 2 shows a schematic cross section along line II—II in FIG. 1.

As shown in FIG. 1, a pad printing machine according to the invention comprises a housing 1; a transmission mechanism 2 which is driven by means of a drive 3; a cliché plate 4 on which a cliché 5 can be fixed in an appropriate way, the cliché plate 4 being movably mounted on a fixed, usually horizontal guide 6; and a pad 7 which can be moved up- and downwards, the pad 7 being fixed to an elongated member 10 which is movable, in this case vertically, between two pairs of guide wheels 8 and 9.

The drive 3 comprises a motor 11, which drives by means of a transmission 12 a horizontal shaft 13, on which a drive disc 14 is mounted; driven discs 15 and 16 are each fixed on a shaft; respectively 17–18, which are freely rotatably mounted in bearings in the housing 1; and an endless transmission 19, more particularly a belt applied around discs 14–15–16.

Preferably, discs 14–15–16 are provided on their circumference with teeth and the endless transmission 19 includes an internally toothed belt or chain as a result of which the three discs 14–15–16 always rotate synchronously with respect to one another.

On the endless transmission 19, a tension mechanism 20 is preferably additionally applied, which mechanism includes a bearing roller 22 movable in a groove 21 so that an optimal tension can always be obtained in the endless transmission 19.

The driven disc 16 possesses preferably half of the number of teeth of the driven disc 15 or, in case the discs are not provided with teeth, the diameter of the driven disc 16 is half of the diameter of the driven disc 15.

Transmission mechanism 2 includes a substantially vertical main arm 23 which is hingedly fixed on a main shaft 24 fixed in the housing 1 and of a lever 25 which is hingedly applied around a pivot 26, this pivot 26 being slidable with respect to shaft 24 by means of a plate 27.

Preferably and as shown in the drawings, the plate 27 is provided with a slot 28 wherein the shaft 24 can be fixed on a predetermined place by means of a clamping element 29.

The clamping element 29 can fix the plate 27 in any manner in a determined position with respect to the main arm 23, for example by making the shaft 24 hollow and by providing a bar through this hollow shaft 24, which bar can operate the clamping element 29 from the outside of the housing 1.

Main arm 23 is connected at its lowermost free extremity by means of a pivot 30 to a bar 31 which is adjustable in length, and which is connected, in turn, by means of a pivot 32, to an L-shaped extension piece 33 of the cliché plate 4.

Bar 31 is in this case composed of two parts 34–35 having respectively a left-hand and a right-hand screw thread on their free extremities, which screw threads cooperate in such a manner with a common nut 36 that the length of the bar 31 can be adjusted by turning the nut 36.

At the back of the main arm 23, more particularly facing disc 15, a groove 37 is provided in the main arm 23, which groove shows a vertical portion 38 with an arcuate portion 39 which is contiguous thereto and which describes a section of a circle with the shaft 17 of the driven disc 15 as a centre point therefor, and a portion 40 which is contiguous to the portion 39 and which is directed radially with respect to the shaft 17.

The extremity of a tap or protrusion 41, fixed to a disc 42 which is itself rigidly fixed to said shaft 17, cooperates with the groove 37.

Lever 25 includes an arm 43, which is connected at its free extremity by means of a pivot 44 and through a bar 45, which is adjustable in length, to elongated member 10 by means of a pin 44', and of an arm 46 forming an angle with arm 43.

A bar 48 is connected freely and hingedly by means of a pivot 47 to the arm 46 and is fixed freely and hingedly, at its second extremity, by means of a pivot 49 to a disc 50 which is itself rigidly fixed onto said shaft 18.

Disk 15, together with protrusion 41 and disk 42 forms a first cam. Disk 16, together with bar 48, forms a second cam.

The operation of a pad printing machine according to the invention is very simple and is as follows.

Figure 3:
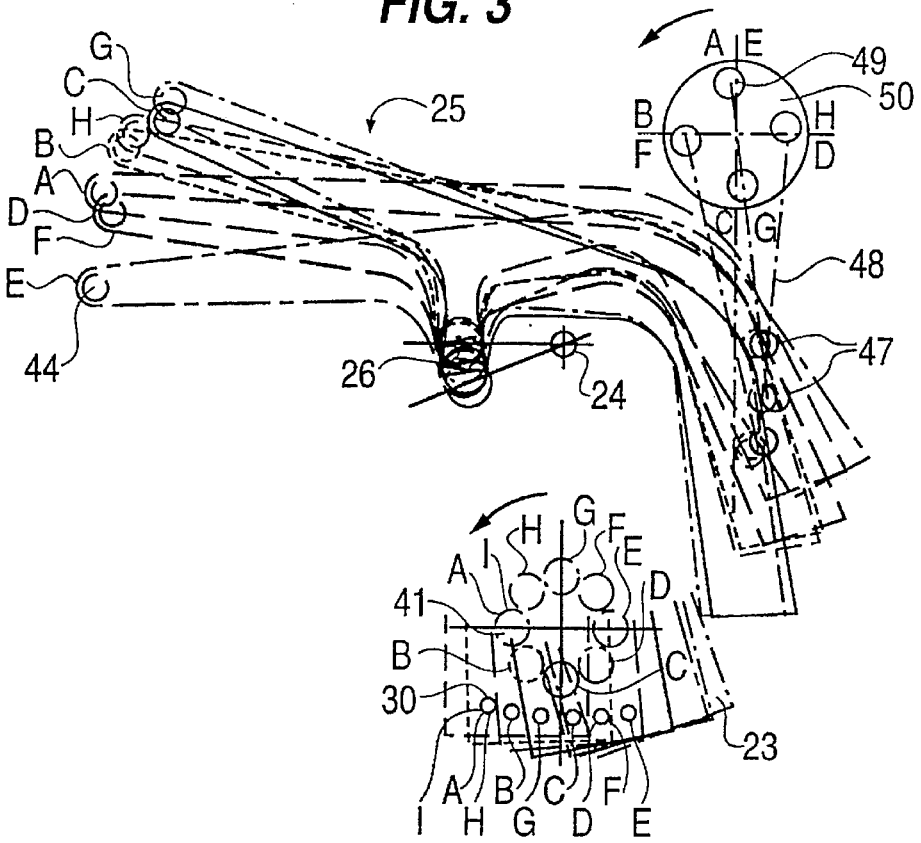
FIG. 3 shows a schematic view of the operation of principal components of a pad printing machine according to the invention.

FIG. 3 shows schematically, in different steps, the different positions of the lever 25 and the main arm 23. For the sake of clarity, each step is shown in another line type, the different steps being successively indicated by a letter from A to H and step I corresponding to the initial position or step A.

As already mentioned hereinbefore, the drive disc 14 drives the two discs 15 and 16 by means of the endless transmission 19.

As a result thereof, both driven discs 15–16 will run synchronously with respect to one another, the disc 16 making two complete rotations for one rotation of the disc 15.

For the sake of simplicity, the most important components have been shown schematically in FIG. 3, these components being restricted to the tap 41 and the pivot 49, the extremity of the main arm 23 with the pivot 30, the lever 25 with the bar 48 and the shaft 24.

In this respect, the movement of the pivot 30 will determine, under the influence of the movement of the main arm 23, the movement of the cliché plate 4 and thus of the cliché 5, whereas the movement of the extremity of the arm 43 of the lever 25 determines the movement of the pad 7.

For the sake of clarity, an entire cycle can be divided in two periods, i.e. a first period wherein the positions A to E are occupied by the different components and a second period wherein the positions F to I are occupied.

During the first period (A to E) of the cycle, the disc 15 rotates and as a result thereof the tap 41 placed on the disc 42 rotates through half a circle, whereby the main arm 23 swings around the shaft 24, because the tap 41 follows the groove 37, so that the cliché plate 4 is displaced in a horizontal plane by means of the bar 31.

At the same moment, because the tap 41 follows the groove 37, the disc 16 and thereby the pivot 49 fixed on the disc 50 is rotated, during this first period (A to E) over a complete circle, the arm 46 of the lever 25 being successively pushed downwards and pulled upwards by means of the bar 48.

Since the lever 25 turns about the pivot 26, the arm 43 of the lever 25 will move respectively upwards and downwards, so that the pad 7 will be moved, by means of the bar 45 and the vertical lath 10, during the first period successively in the steps A–B–C, vertically upwards, and in the steps C–D–E downwards.

It is noted that during the last stage this first period C–D–E, the pivot 26 of the lever 25 moves downward over a determined arc with the shaft 24 as centre point, whereby the swinging movement of the lever 25, which moves the pad 7 upwards, is reduced, whereas the swinging movement, which moves the pad 7 downwards, is enhanced.

During the second period (F to I), the disc 15 and thereby also the tap 41 rotates further over half a circle so as to occupy the initial position A. The main arm 23 and the pivot 26 of the lever 25 is swung around the shaft 24 during the steps F–G–H, as a result of which the cliché plate 4 is moved to the front and will remain in the same position during the steps H and I because the tap 41 moves in the circular portion 39 of the groove 37 in the main arm 23.

At the same moment, the disc 16 and thereby the pivot 49 rotates during the second period (F to I) over a complete circle which successively pushes the arm 46 of the lever 25 downwards and brings it upwards.

Because the lever 25 swings around the pivot 26, the arm 43 of the lever 25 will move again respectively upwards and downwards or in other words, the pad 7 will be moved, by means of the bar 45 and the vertical elongated member 10, in the steps E–F–G upwards and in the steps G–H–I downwards.

In this respect, it is important that, during the downward displacement of the pad 7 from the position H to I, the cliché plate 4 does not perform any movement so that a perfect impression of the cliché on the pad 7 is made.

By varying the distance between the pivot 26 and the shaft 24, the amplitude over which the pad 7 moves can be increased or decreased. This modification is possible since the main arm 23 is connected indirectly to the lever 25 by means of a plate 27.

The amplitude of the movement of the pad is indeed a function of the distance between the pivot 26 of the lever 25 and the shaft 24.

It is clear that a pad printing machine according to the invention reduces or obviates the above mentioned and other drawbacks of the known pad printing machines entirely because the transmission mechanism 2 comprises clearly less components than the known pad printing machines, whereby a simple and reliable construction is obtained.

The present invention is further not at all limited to the embodiment described hereinbefore and shown in the figures, but a pad printing machine according to the invention can be realized in all kinds of shapes and dimensions, without affecting the scope of the invention.

I claim:

1. A pad printing machine comprising:

a cliché plate;

a pad disposed above the cliché plate;

a transmission mechanism operatively connected to the cliché plate and to the pad and comprising:

a main shaft;

a main arm connected to the cliché plate and pivotably mounted on the main shaft;

a pivot arrangement connected to the main arm;

a lever pivotably mounted on the pivot arrangement and connected to the pad; and means for controlling a pivoting motion of the main arm and of the lever including:

a first cam operatively coupled to the main arm;

a first shaft disposed such that the first cam is rotatably fixed thereon;

a groove disposed in one of the first cam and the main arm for controlling a pivoting motion of the main arm in response to a rotation of the first cam;

a second cam operatively coupled to the lever such that a rotation of the second cam controls a pivoting motion of the lever; and a second shaft disposed such that the second cam is rotatably fixed thereon; and a drive for actuating the transmission mechanism to move the cliché plate and the pad.

2. The pad printing machine according to claim 1, wherein the drive comprises:

a motor; and a drive disk connected to the motor; and the transmission mechanism further includes:

a first driven disk operatively coupled to the drive disk, the first cam comprising the first driven disk;

a second driven disk operatively coupled to the first driven disk, the second cam comprising the second driven disk; and an endless transmission component engaging the drive disk and the driven disks thereby operatively connecting the drive disk and the driven disks to one another.

3. The pad printing machine according to claim 2, wherein:

the drive disk and the driven disks include teeth at circumferences thereof; and the endless transmission component comprises teeth at an interior side thereof for engaging the teeth on the circumferences of the drive disk and of the driven disks.

4. The pad printing machine according to claim 3, wherein the second driven disk includes half as many teeth as the first driven disk.

5. The pad printing machine according to claim 1, wherein the pivot arrangement includes a plate which effects a slidable mounting of the pivot arrangement on the main shaft.

6. The pad printing machine according to claim 4, wherein:

the plate defines a slot therein; and the pivot arrangement includes a clamping element thereon for fixing the pivot arrangement with respect to the main shaft.

7. The pad printing machine according to claim 1, wherein:

the pivot arrangement is a first pivot arrangement;

the cliché plate includes an L-shaped extension thereon; and the transmission mechanism further comprises a second pivot arrangement including:

a bar;

a first pivot pivotably connecting one end of the bar to a lowermost extremity of the main arm; and a second pivot pivotably connecting another end of the bar to the L-shaped extension of the cliché plate.

8. The pad printing machine according to claim 1, wherein the groove is disposed at the back region of the main arm and faces the first driven disk.

9. The pad printing machine according to claim 7, wherein the groove includes:

a straight portion;

an arcuate portion contiguous with the straight portion and defining a portion of a circle having a center coinciding with a longitudinal axis of the first shaft; and a radial portion contiguous to the arcuate portion and oriented in a radial direction with respect to the first shaft.

10. The pad printing machine according to claim 9, wherein the transmission mechanism further includes a supplemental disk rotatably fixed on the first shaft and including a protrusion thereon, the protrusion cooperating with the groove for controlling a pivoting motion of the main arm.

11. The pad printing machine according to claim 1, wherein:

the pivot arrangement is a first pivot arrangement;

the lever includes:

a lever arm portion; and an angled arm portion connected to the lever arm portion; and the transmission mechanism further comprises:

a vertically movable elongated member fixed to the pad; and a second pivot arrangement connected to the lever arm portion and including:

a bar connected at one end thereof to the elongated member; and a pivot pivotably connecting an extremity of the lever arm portion to another end of the bar.

12. The pad printing machine according to claim 11, wherein:

the bar is a first bar;

the pivot is a first pivot; and the transmission mechanism further comprises:

a second bar;

a second pivot pivotably connecting the angled arm portion to one end of the bar;

a supplemental disk rotatably fixed on the second shaft; and a third pivot pivotably connecting the supplemental disk to another end of the bar.

* * * * *